US005722653A

United States Patent [19]

Seidl et al.

[11] Patent Number: 5,722,653

[45] Date of Patent: Mar. 3, 1998

[54] SINGLE-SHEET FEEDER

[75] Inventors: Maximilian R. Seidl, Munich; Karl Hasenöhrl, Hallbergmoos, both of Germany

[73] Assignee: Avery Dennison Corporation, Pasadena, Calif.

[21] Appl. No.: 506,687

[22] Filed: Jul. 25, 1995

(Under 37 CFR 1.47)

[30] Foreign Application Priority Data

Jul. 25, 1994 [DE] Germany ..... 44 26 298.1

[51] Int. Cl.[6] ..... B65H 3/06

[52] U.S. Cl. ..... 271/117; 271/126; 271/121; 271/124; 271/153; 271/154

[58] Field of Search ..... 271/121, 126, 271/124, 153–156, 236, 117

[56] References Cited

U.S. PATENT DOCUMENTS

| | | | |
|---|---|---|---|
| 2,989,307 | 6/1961 | Weidenhammer | 271/155 X |
| 3,749,395 | 7/1973 | Bazzarone et al. | 271/153 X |
| 4,461,466 | 7/1984 | Uchida et al. | 271/126 X |
| 4,548,397 | 10/1985 | Runzi | 271/121 |
| 5,123,637 | 6/1992 | Muzaka | 271/126 X |

FOREIGN PATENT DOCUMENTS

| | | | |
|---|---|---|---|
| 203041 | 9/1986 | Japan | 271/126 |
| 23129 | 1/1990 | Japan | 271/121 |
| 264428 | 11/1991 | Japan | 271/121 |

*Primary Examiner*—Boris Milef

*Attorney, Agent, or Firm*—Christie, Parker & Hale, LLP

[57] ABSTRACT

Described is a single-sheet feeder comprising a sheet transporter and a movable carrier for individual sheets which defines a plane, a first flat reference stop which serves as a side edge guide for the sheets and extends substantially perpendicular to the carrier, and a second reference stop which serves as a leading edge guide for the sheets and extends substantially perpendicular to the carrier and the first reference stop.

10 Claims, 5 Drawing Sheets

SINGLE-SHEET FEEDER

FIELD OF THE INVENTION

The invention relates to a single-sheet feeder or an apparatus including such a single-sheet feeder comprising a sheet transporter and a movable carrier for individual sheets.

BACKGROUND OF THE INVENTION

A single-sheet feeder or apparatus including such a single-sheet feeder is known from U.S. Pat. No. 4,372,547 incorporated herein by reference. In it is shown an apparatus for the separation of the top sheet from a stack of sheets in which a stack of sheets is positioned in a cassette and is pushed from below against a transport roller situated above the stack of sheets, the axis of the shaft of the transport roller being at a fixed distance from the cassette.

Single-sheet feeders of various types are commonly used in apparatus such as printers, copiers, faxes etc. for feeding to the printing device contained in this apparatus single sheets from a stack of sheets so as to ensure orderly printing operation. However, the known single-sheet feeders can usually handle only sheets of a certain size. When a change to a different size is required, changes of the single-sheet feeder must be carried out which happens generally by the adaptation of the single-sheet feeder as regards side edge guides for the sheets. In the apparatus shown in DE-2952671 increasing of the sheet size is restricted by the size of the cassette. In addition the top sheet must be seized by a corner holder.

IBM Technical Disclosure Bulletin, Vol. 20, No. 4, September 1977, p. 1295 discloses a single-sheet feeder comprising a sheet transporter and a carrier for individual sheets and a first flat reference stop which serves as a side edge guide for sheets and extends substantially perpendicular to the carrier, in which the arrangement of the transport roller near the flat reference edge ensures that even unaligned individual sheets are aligned parallel to the reference edge and are withdrawn in this position.

From CH 682321 is further known a device for feeding paper-type indication carriers, and office machine and a process for the operation of the device which enable adaptation to a certain sheet size for larger quantities of sheets. After setting of the single-sheet feeder for a certain paper size, the feeder is generally only capable of processing this size sheet. Sheet sizes where the sheet side edge length is greater than the set lead edge length cannot be processed, and sheet sizes with a smaller lead edge length cause generally failure of the single-sheet feeder, because their orderly seizing is not possible with any certainty. This is particular undesirable in cases of printing on sheets of varying sizes or printing of only small runs of varying sizes, which is not infrequent when printing labels.

U.S. Pat. No. 4,097,041, incorporated herein by reference, describes a sheet feeder in which sheet transporter has an upper stop and a stop for a leading edge guide which may be swung together.

Finally from U.S. Pat. Nos. 3,601,389 and 3,592,462, each incorporated herein by reference, is known a device for the removal of single sheets from a stack of sheets, in which a damping plate bears onto the top sheet in the stack, and the damping plate is laterally delimited by an edge plate which lies with its upper edge below the damping plate so that a gap is defined between the damping plate and the edge plate through which a sheet may be transported.

SUMMARY OF THE INVENTION

There is provided in accordance with the invention a simple single-sheet feeder which enables processing of individual sheets of different sizes without the need for manual or mechanical resetting to new sheet sizes and which enables the top sheet to be reliably removed from a stack.

This is achieved according to the invention by a single-sheet feeder or an apparatus including such a single-sheet feeder, comprising a sheet transporter and a movable carrier for individual sheets which defines a plane, a first flat reference stop which serves as a side edge guide for the sheets and extends substantially perpendicular to the carrier, and a second reference stop which serves as a leading edge guide for the sheets and extends substantially perpendicular to the carrier and the first reference stop, wherein the transporter has an upper stop and a stopping edge which is positioned in the extension of the second reference stop below the upper stop.

The invention is based on the recognition that a third reference stop, which would contact the transported sheet on a third side, may be dispensed with. The fixing of sheet support with two degrees of freedom, namely the first and the second reference stop, is sufficient for reliable single-sheet feeding. In addition the design of an upper stop and also a stopping edge, which is situated in the extension of the second reference stop below the upper stop, may be simply accomplished on the sheet transporter, whereby the structural complexities of the single-sheet feeder are much simplified compared with known devices for the separation of sheets. Because the cooperation of mutually accurately aligned parts, such as transport roller, upper stop and front stopping edge for the leading edge guide for sheets are all positioned on a single part, namely on the transport device, their cooperative interrelationship remains exact, insuring thereby reliable sheet transport for any sheet seizing.

The single-sheet feeder according to the invention is characterized by a very simple design while the need for means for adapting to sheet size is entirely avoided. When the single-sheet feeder is operated, all the user has to do is to simply place the sheets onto the carrier for individual sheets so that the sheets contact the first and second reference edges, and then to align it.

It is obvious that by dispensing with the adaptation device or with a third reference stop for the sheets, the single-sheet feeder is lower in cost, the operation is simplified, and incorrect attention and associated expenses in the case of failure are avoided.

It was found that the arrangement of a transport device on the side of the first reference stop is sufficient to reliably withdraw the sheets of the feeder although the transport device covers only a relatively small zone of the inserted sheets.

The transporter is preferably arranged to swingably move above the carrier to reliably seize and remove the uppermost sheet from a stack which is urged or pressed by the carrier against the transporter. The stationary arrangement of the main parts for seizing and removal of the sheets, such as the transport roller, pressing roller and dispenser edge, further enables easy and simple replacement and repair or adjustment of such parts. The dispenser edge is situated in the extension of the second reference stop, separately therefrom, with a spacing below the pressing roller which is made as an upper stop.

In order to achieve a reliable adjustment of the stack of sheets on the carrier, the carrier drive is controlled as a function of the swinging-out of the transport device. The angle of swinging-out, which may be simply detected by a sensor, may serve as a measure of the swinging-out.

BRIEF DESCRIPTION OF THE DRAWINGS

The invention will now be explained in greater detail, by way of example, on one embodiment illustrated in the drawings, in which.

DETAILED DESCRIPTION

Figure 1:
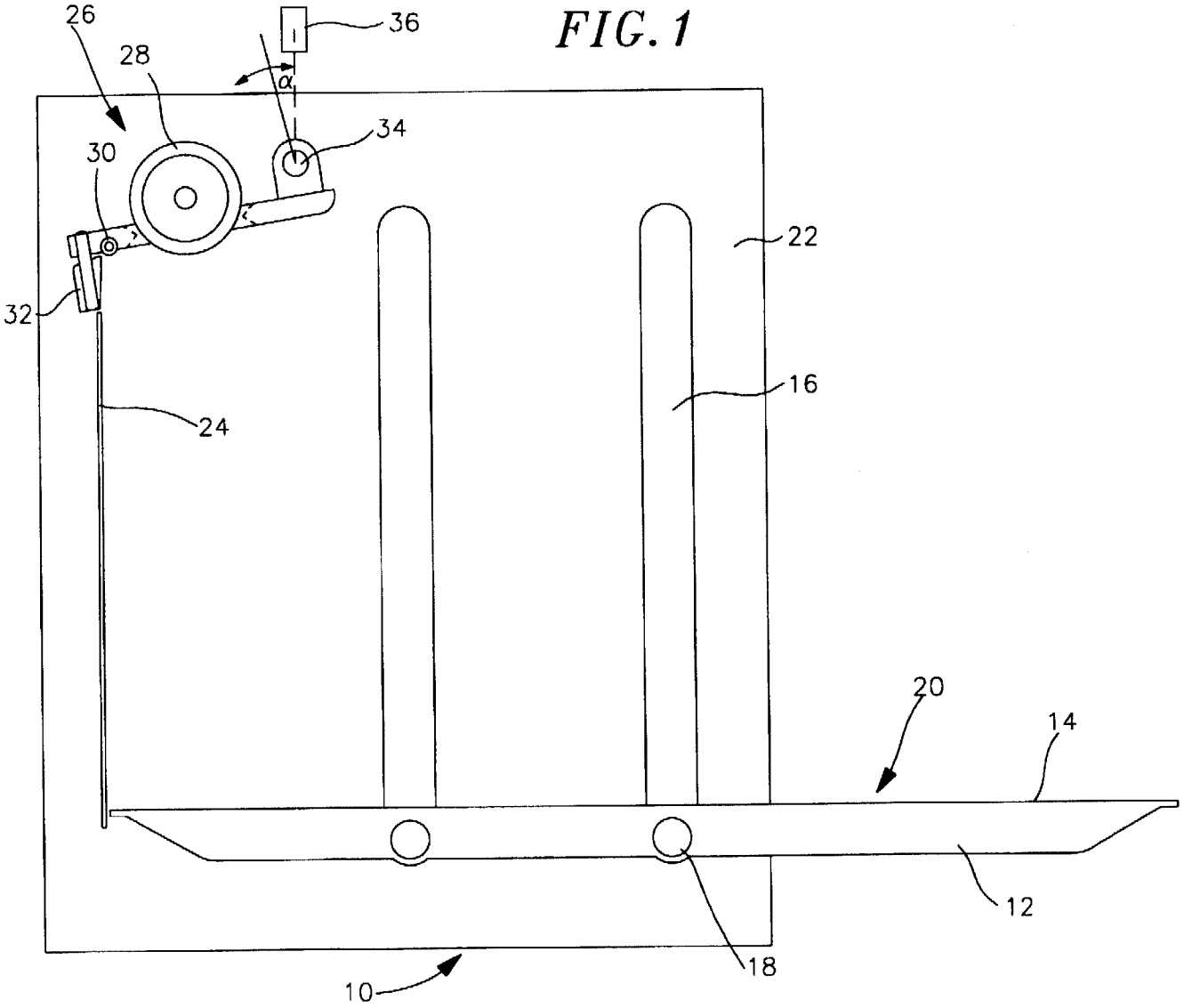
FIG. 1 is a side elevation of a single-sheet feeder according to the invention without inserted sheets.

FIG. 1 shows a single-sheet feeder 10 comprising a carrier 12 in the form of a flat plate 14 which may be guided along guide rails 16 in which are inserted guiding pin 18 of carrier 12. The carrier is driven by a known motor (not shown) provided with control means. The single-sheet feeder may form part of an apparatus (not shown) provided with a printing device, such as a laser printer, a thermal printer and the tube.

The plane 20 of the carrier extends perpendicular to a first planar reference stop 22 which lies in the plane of the drawing and serves as a side edge guide for the sheets. Perpendicular to the plane of carrier 12 and to the first planar reference stop 22 is a second reference stop 24. Situated above the carrier 12 are pivotably swingable transport device 26 which comprises a transport roller 28, a pressing roller 30 serving as an upper stop, and also a stopping edge which is situated in or as the extension of the second reference stop 24, and designed as a dispenser edge 32. It is positioned below the upper stop 30, which contacts the carrier or carrier contained stack of sheets. The axis 34 of swing of the transport device 26 is perpendicular to the first planar reference stop 22. When the transport device 26 is at rest, it contacts the second reference stop 24.

Sensor 36 may be employed to detect the swinging-out angle ($\alpha$) or pivot of transport device 26 about its axis, the angle being used as a control means to actuate an adjustment means or motor control or other control device (not shown) for controlling and raising carrier 12. The object is to move the carrier upwards as sheets are dispensed to ensure that a dispensable sheet remains positioned for dispensing by transport roller 28.

Figure 2:
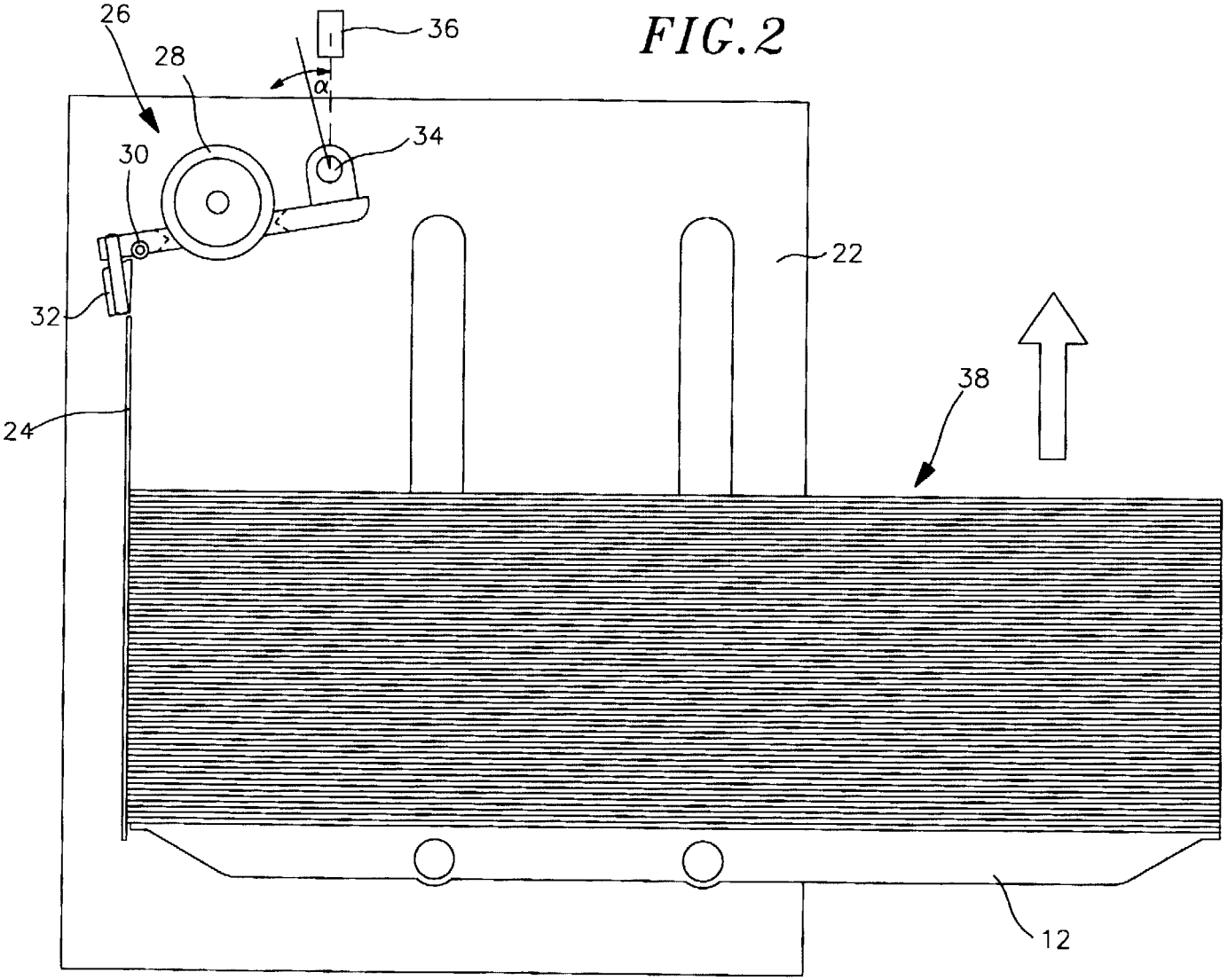
FIG. 2 is a side elevation of a single-sheet feeder according to FIG. 1 with an inserted stack of sheets.

FIG. 2 shows how a stack 38 of sheets, e.g. of paper, foils and the like is positioned on carrier 12 which moves upwards (arrow) in the direction to the transport device 26. The carrier adjustment raises the stack of sheets so far that the transport device 26 is lifted and the swinging-out angle assumes a zero value. At this stage the single-sheet feeder is ready for operation, i.e. to dispense sheets, as is shown in FIG. 3.

Figure 3:
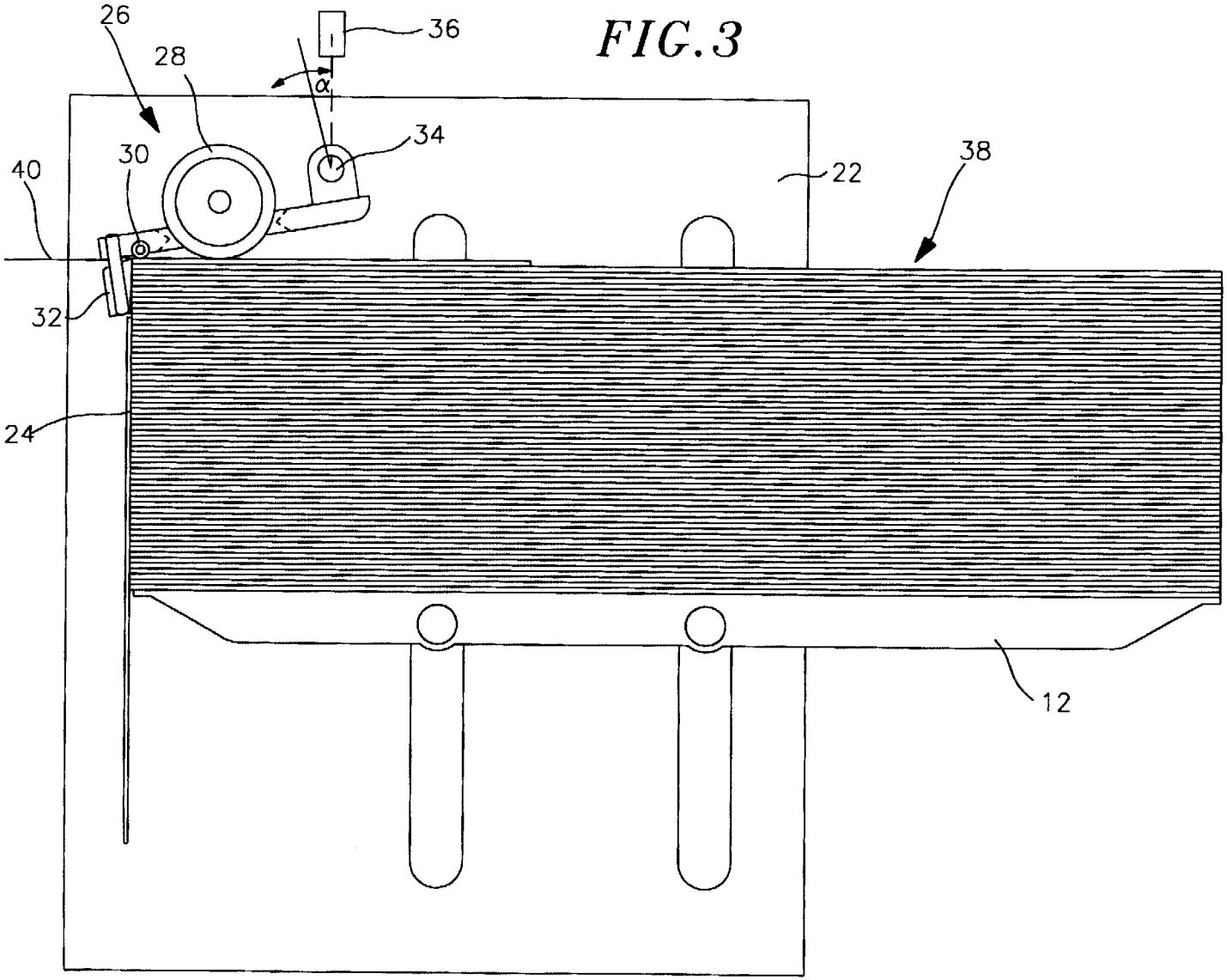
FIG. 3 is a side elevation of a single-sheet feeder according to FIG. 2 in which the stack of sheets is lifted to the transport device.
Figure 4:
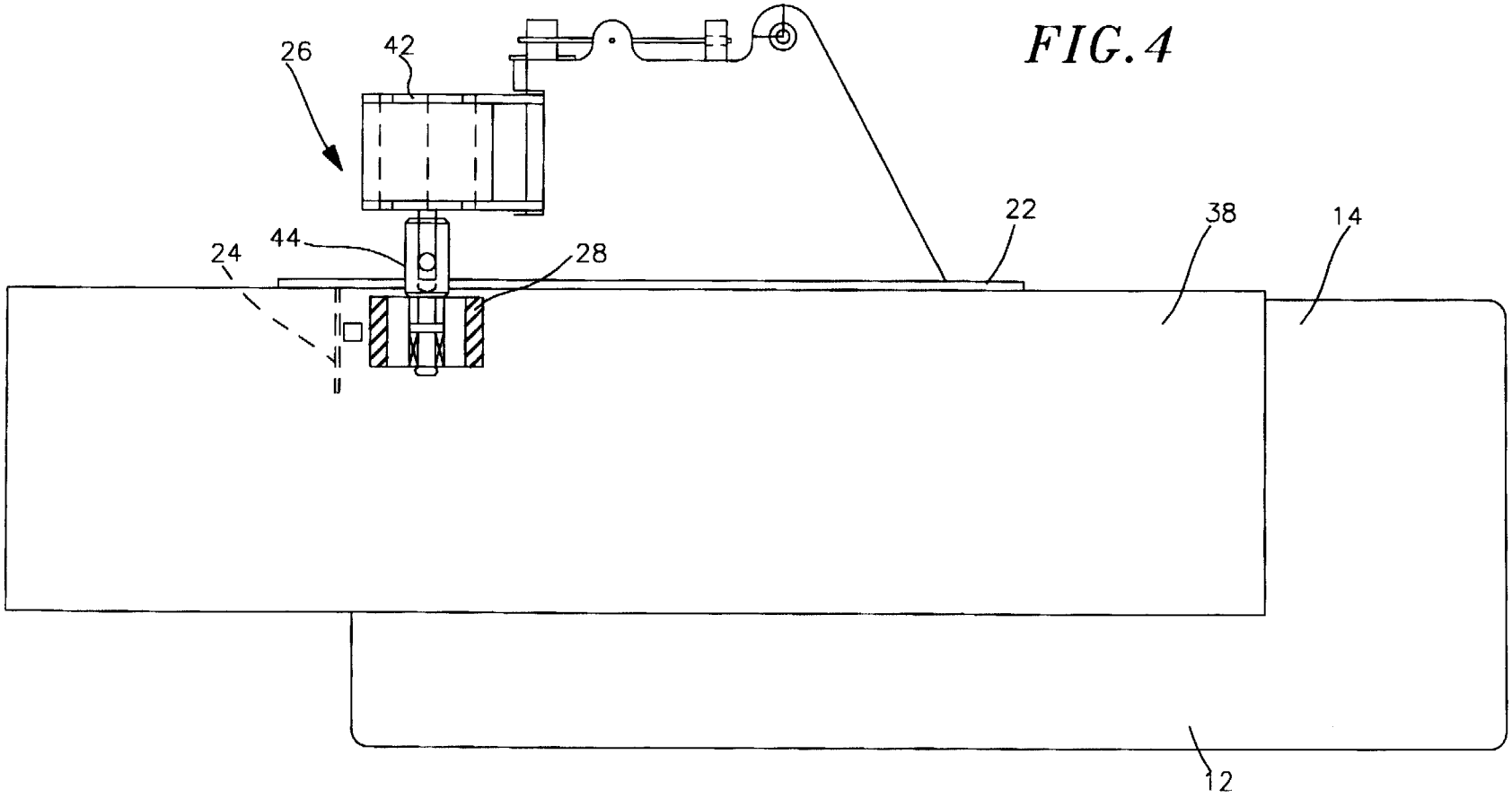
FIG. 4 is a plan view of the single-sheet feeder illustrated in FIG. 3.

FIG. 4 shows the plan view of FIG. 3, and of the single-sheet feeder in which a sheet 40 is being transported or dispensed. As is shown, driving means 42 for the transport roller 28 is situated behind the first planar reference stop and is connected to the transport roller 28 by a shaft 44 extending through the first planar reference stop 22. The transport roller 28 is situated in the direction of transport (arrow) shortly before or ahead of the second reference stop 24.

The view makes it clear that by the first and second reference stops are determined only two degrees of freedom for fixing the position of a sheet, so that sheets of many different sizes may be positioned on the plate 14 and be reliably seized by the transport device 26.

Figure 5:
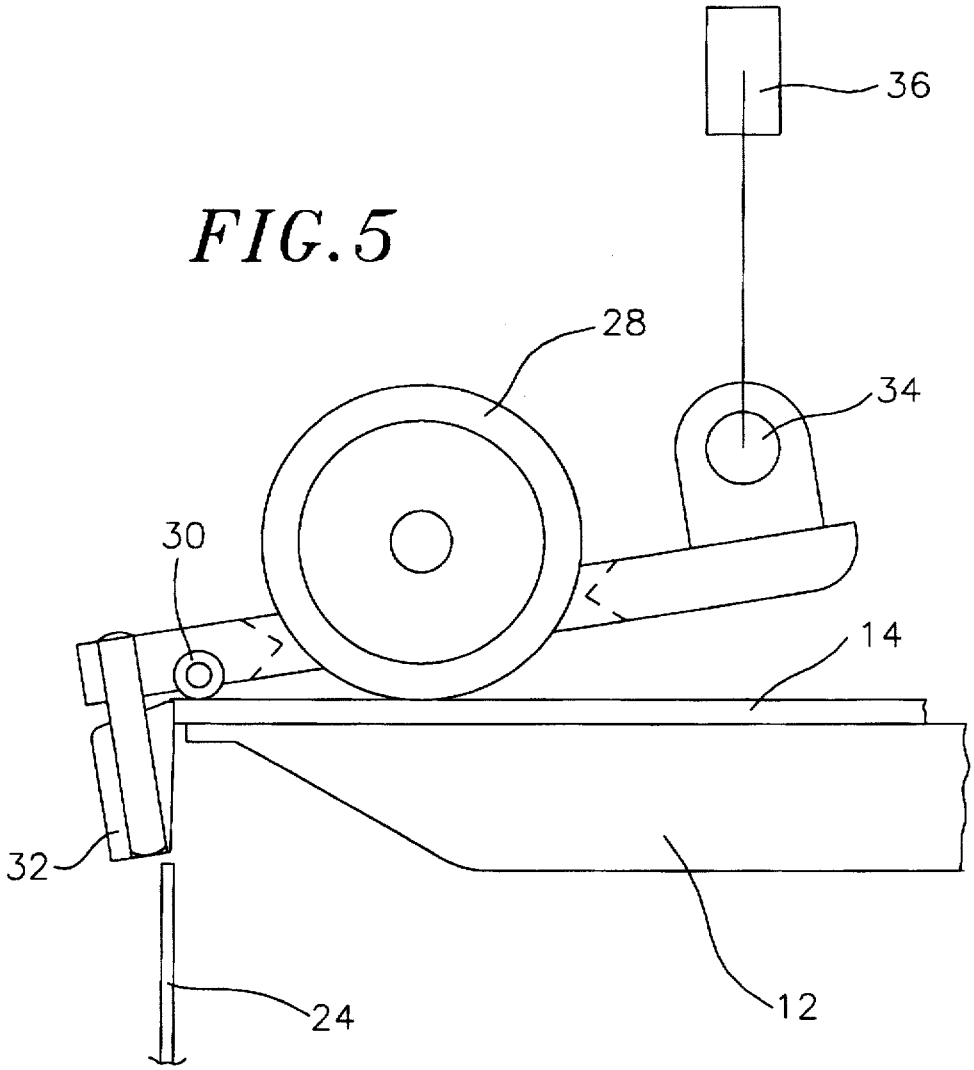
FIG. 5 is an enlarged cut-out from the single-sheet feeder of FIG. 4.
Figure 6:
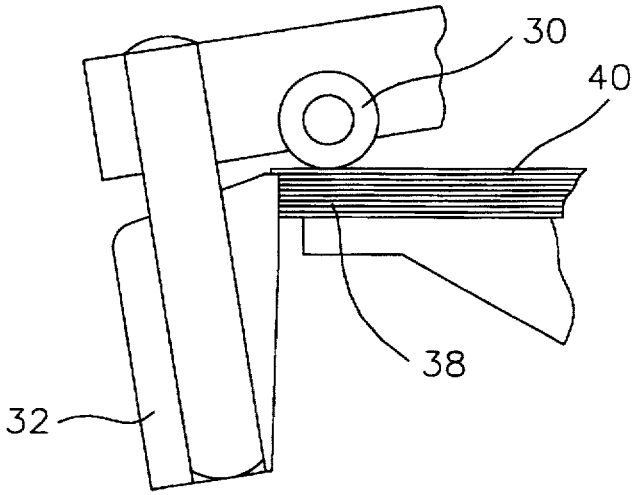
FIG. 6 is a further enlarged cut-out of a part of the single-sheet feeder of FIG. 5.

FIGS. 5 and 6 show enlarged view of the single-sheet feeder 10 in the region of the transport device 26. The front edge of the dispenser edge 32 is situated, separated from the second reference stop 24 in the extension of the second reference Stop 24 at a certain distance below the pressing roller 30. The distance between the dispenser edge 32 and the pressing roller 30 is sufficient for a sheet 40 to pass between them. (See FIG. 6.) The distance between the dispenser edge 32 and the pressing roller 30 is adjustable.

What is claimed is:

1. Single-sheet feeder comprising:

(a) a movable carrier for individual sheets defining a plane;

(b) a substantially planar first reference stop which serves as a side edge guide for the sheets and extends substantially perpendicular to the carrier;

(c) a second reference stop which serves as a leading edge guide for the sheets extending substantially perpendicular to the carrier and the first reference stop; and (d) sheet transport means swingably situated above the carrier along the first reference stop and comprising a roller means for transporting a sheet from a stack of sheets on the carrier, an upper stop means and a sheet dispenser edge separated from the upper stop means by a space sufficient to allow dispensing of a sheet therebetween, wherein said roller means transports a sheet between said upper stop means and said sheet dispenser edge and wherein said plane of the carrier, said first reference stop and said second reference stop cooperate to position sheets in a stack for dispensing by said transport means.

2. Single-sheet feeder as claimed in claim 1, in which the sheet transport means is positioned to swing about an axis extending perpendicular to the first reference stop and above the carrier.

3. Single-sheet feeder according to claim 1 further comprising a control means for controlling the movement of the carrier in response to the angle of swing of the sheet transport means.

4. Single-sheet feeder as claimed in claim 3 in which the control means comprises sensor means for the detection of the angle of swing of the sheet transport means.

5. Single-sheet feeder according to claim 2 further comprising a control means for controlling the movement of the carrier in response to the angle of swing of the sheet transport means.

6. Single-sheet feeder as claimed in claim 2 in which the control means comprises sensor means for the detection of the angle of swing of the sheet transport means.

7. Single-sheet feeder according to claim 1, wherein the distance between the dispenser edge and the upper stop means is adjustable.

8. A single-sheet feeder comprising:

(a) a vertically movable, driven carrier providing a horizontally oriented planar surface for sheets to be dispensed;

(b) vertically oriented first planar reference stop surface providing a side edge guide for sheets and extending substantially perpendicular to the carrier;

(c) a second reference stop providing a leading edge guide for the sheets and extending substantially perpendicular to the carrier and the first reference stop;

(d) sheet transport means for dispensing sheets from a stack of sheets positioned on the movable carrier and supported against the first and second reference stops, said sheet transport means pivotably positioned above the carrier along the first reference stop and providing a roller means for transporting a sheet from a stack of sheets on the carrier, an upper stop means and a sheet dispenser edge separated from said upper stop means by a space sufficient to allow dispensing of a sheet therebetween; and (e) means operative in response to the angle of swing of the sheet transport means to advance said carrier upwards towards said sheet transport means.

9. A single-sheet feeder as claimed in claim 8 further comprising sensor means for detecting the angle of swing of the sheet transport means.

10. A single-sheet feeder as claimed in claim 8 in which the sheet transport means contacts at rest the second reference stop.

* * * * *